United States Patent [19]

Matty et al.

[11] 4,235,402

[45] Nov. 25, 1980

[54] TRAIN VEHICLE SPEED CONTROL APPARATUS

[75] Inventors: Thomas C. Matty, North Huntingdon; Howard N. Miller, McMurray, both of Pa.

[73] Assignee: Westinghouse Electric Corp., Pittsburgh, Pa.

[21] Appl. No.: 751,823

[22] Filed: Dec. 17, 1976

Related U.S. Application Data

[63] Continuation of Ser. No. 618,095, Sep. 30, 1975, abandoned.

[51] Int. Cl.[2] ..... B61L 3/12

[52] U.S. Cl. ..... 246/182 B; 303/106; 246/63 C

[58] Field of Search ..... 105/61; 180/82 R, 82 D; 188/181 A; 246/63 R, 63 C, 182 R, 182 B, 182 C, 187 R, 187 A, 187 B; 303/97, 105, 106, 110

[56] References Cited

U.S. PATENT DOCUMENTS

| | | | |
|---|---|---|---|
| 3,363,096 | 1/1968 | Hughson et al. | 246/187 B |
| 3,482,887 | 12/1969 | Sheppard | 246/182 R X |
| 3,538,325 | 11/1970 | Smith et al. | 246/63 R |
| 3,556,610 | 1/1971 | Leiber | 303/106 X |
| 3,584,921 | 6/1971 | Crawford | 180/82 D X |
| 3,757,166 | 9/1973 | Clifford et al. | 303/97 X |
| 3,825,306 | 7/1974 | Fink | 303/105 |
| 3,967,862 | 7/1976 | Hunter et al. | 246/182 B X |

*Primary Examiner*—Trygve M. Blix
*Assistant Examiner*—Reinhard J. Eisenzopf
*Attorney, Agent, or Firm*—R. G. Brodahl

[57] ABSTRACT

The present invention relates to a train vehicle speed control apparatus which recognizes a change in one of the acceleration rate or the deceleration rate of a train moving along the track and the control of the train velocity in relation to what distance will be required for a desired operation of the train such as a predetermined decrease in the train speed or a stopping of the train. If the deceleration rate has changed, for example, the fixed physical system limits what control can be exercised and the velocity of the train can be modified to adjust the actual stopping distance used by the train or with a fixed stopping distance desired then the permitted train velocity can be changed.

1 Claim, 6 Drawing Figures

TRAIN VEHICLE SPEED CONTROL APPARATUS

This is a continuation of application Ser. No. 618,095 filed Sept. 30, 1975, now abandoned.

BACKGROUND OF THE INVENTION

It is known to control the movement speed of one or more train vehicles moving along a track including a plurality of signal blocks through the use of speed code signals in accordance with desired fail-safe control system operation. Prior art discloses of similar railway track signaling systems can be found in U.S. Pat. No. 3,562,712 of G. M. Thorne-Booth et al, U.S. Pat. No. 3,551,889 of C. S. Miller and U.S. Pat. Nos. 3,532,877 and reissued 27,472 of G. M. Thorne-Booth. In addition, an article entitled "Design Techniques For Automatic Train Control" by R. C. Hoyler in the Westinghouse Engineer for July, 1972 at pages 98 to 104 and an article entitled "Automatic Train Control Concepts Are Implemented By Modern Equipment" by R. C. Hoyler in the Westinghouse Engineer for September, 1972 at pages 145 to 151 describes train control equipment design for safe operation.

For the purpose of starting and stopping the movement of a train, it is desired to know the value of the adhesion coefficient of friction between the train wheels and the track rail upon which the train is moving. The operational speed permitted for a second train following an earlier first train is determined in part by the location of the first train on the track ahead of the second train as well as the adhesion condition of the track ahead of the second train. If it is desired to stop the second train a predetermined safe distance behind the first train with no concern about a collision between the two trains, it is necessary to determine a safe distance to begin stopping the second train behind the first train. This distance is a function of the adhesion level and the resulting deceleration rate that can be reasonably achieved by braking the train in relation to the train velocity. In general this stopping distance D can be determined by the relationship:

$$D = V^2/2R \quad (1)$$

where V is the train velocity and R is the known deceleration rate. If rain, ice or some other film material is present on the track, this will change the deceleration rate R.

It is known to provide wheel slip or slide detection and control apparatus to remove a command for propulsion or braking of the train until the abnormal adhesion situation is corrected. The tractive or braking effort being applied to the wheel axle must be corrected to permit the wheels to regain the speed equivalent of the train speed. A speed signal is developed for each axle by suitable speed sensors with a D.C. output voltage proportional to frequency of the output of the speed sensor being developed and a derivative of this voltage being used to trigger a slip slide control system, as described in a publication entitled "Propulsion Control For Passenger Trains Provides High Speed Service" by J. E. Moxie et al in the Westinghouse Engineer for September, 1970, at pages 143 to 149. When the derivative voltage exceeds a value equivalent to wheel acceleration or deceleration of 8 miles per hour per second, an output from the slip slide control system picks up a relay to initiate action that reduces the tractive or braking effort until the slip or slide is eliminated. Once the slipping or sliding condition has been eliminated the wheels should return to a speed equivalent to train speed. An assumption can be made that the return to speed will be in the order of the rate of 8 miles per hour per second or greater, therefore a speed derivative with a sign opposite the sign of the derivative signal that initiated the reduction in tractive or braking effort can be used to reset the control system, eliminate the system output, drop out the control relay and reestablish the desired braking or tractive effort. It is recognized that the assumption that an equivalent wheel deceleration always follows a wheel slip acceleration and vice versa may not be valid and for this reason a time out circuit is provided with timing initiated when a system output signal occurs. If the opposite sign derivative does not occur before the end of three seconds, the control system is reset and the relay dropped out by the timing circuit which relay drop out then permits the desired tractive or braking effort to be reestablished.

SUMMARY OF THE INVENTION

The slip slide control signal operates with the speed command control equipment carried by the train to lower the vehicle operating speed down to a safe minimum adhesion level, which has been previously determined and permits stopping the train in the provided distance. The vehicle either stops in accordance with a normal level of operation or in accordance with a predetermined minimum level of operation. If desired an adaptive control system can be provided knowing the train characteristics and the extend and kind of the slip slide track condition that has actually occurred. A time duration can be sensed for a given slip slide condition or several short time slip slide conditions are integrated to slow down the train speed. By using a control signal determined by the activity of the vehicle wheels it can be determined if only a short slip slide condition occurrence is presented or an extended slip slide activity condition is presented.

The present speed control apparatus can be onboard carried by each vehicle so each train determines its own response. The first train in the morning, for example, moves into an environment including fog and rain with some rust film on the rails and may experience a considerable amount of slip slide activity and have to operate at some reduced level. However, the tenth or may be the twentieth train that passes over the same rails the same day will probably be able to operate at the normal speed level.

DESCRIPTION OF THE PREFERRED EMBODIMENT

Rapid transit systems generally achieve large flow capacity of maximizing the performance of the train vehicle within the constraints of the system safety. As a rule headways and/or close up distances are based upon the speed and braking rate, for example, if a speed V is being maintained for the train vehicle and a braking rate R is available then the distance D is required to stop the vehicle as set forth by above equation (1). If the available braking rate R is reduced, then either the distance D must be increased or the velocity V reduced to achieve their required safety margin. This present invention can be utilized to allow the maximum use of available deceleration capability of the train vehicle in relation to the track in order to preserve system safety. It was known in the prior art to determine the system safety criteria assuming either an average value of the coefficient of friction for all parts of the system under all conditions or a minimum value existed as a worse case for all calculations. Assuming that the first condition is made it is easily understood that under an adverse condition it might be feasible to cause an accident because of a lesser than average required deceleration rate being available, and assuming the second case it is again easily seen that if all margins are calculated on a worse case basis, significant deterioration of system capability results. The present invention is adaptable to automatic or manual control systems for achieving maximum useful capacity consistent with the available deceleration or acceleration rate and is particularly useful in automatic systems that are used in regions where sudden climatic changes cause significant change in traction capability.

Figure 1:
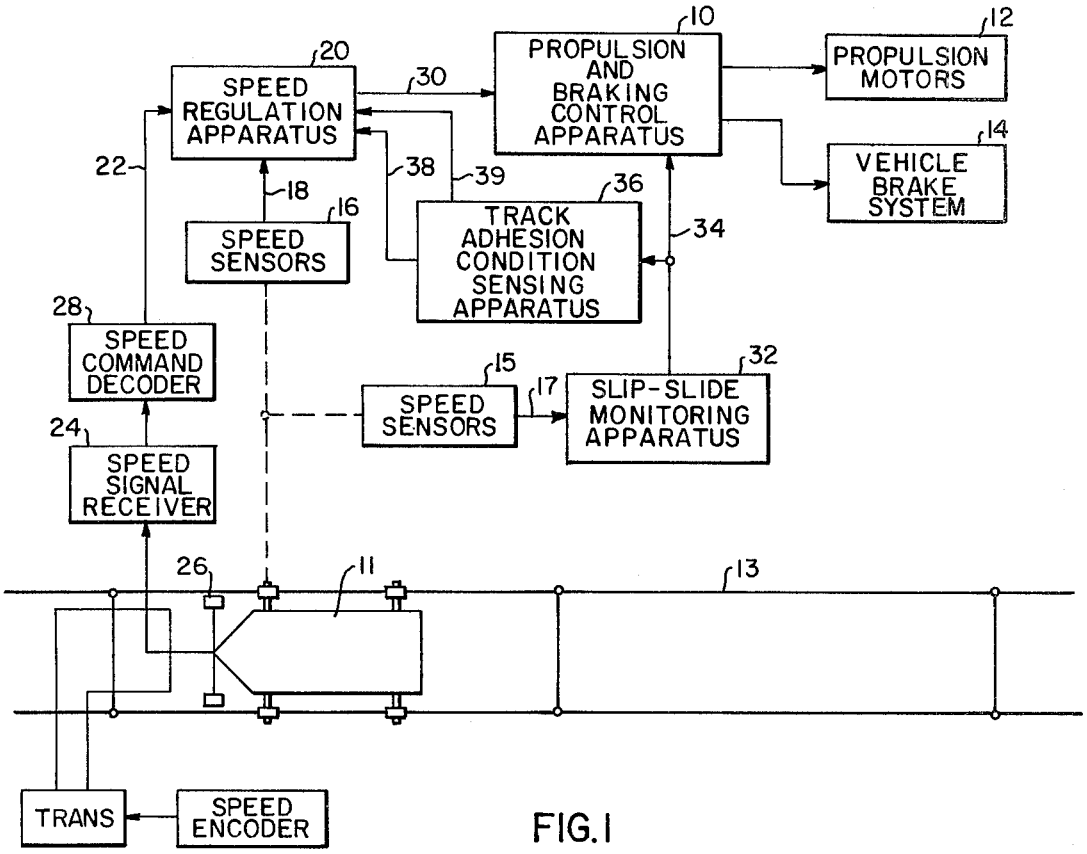
FIG. 1 is a schematic showing of the present train vehicle speed control apparatus.

As shown in FIG. 1 a propulsion and braking control apparatus 10 carried by a train vehicle 11 in relation to movement along a track 13 is operative with one or more propulsion motors 12 and the vehicle brake system 14. One or more tachometer speed sensors 16 coupled to the vehicle wheels provide an actual speed feedback signal over conductor 18 to the vehicle speed regulation apparatus 20. A desired speed signal is supplied over conductor 22 to the speed regulation apparatus 20 from a speed signal receiver 24 operative with an antenna 26 carried by the vehicle 11 and a speed command decoder 28. The speed regulation apparatus 20 provides a P signal as described in an article entitled "Automatic Train Control Concepts Are Implemented By Modern Equipment" by R. C. Hoyler and published at pages 145 to 151 in the September, 1972 Westinghouse Engineer and in the above-mentioned article entitled "Propulsion Control For Passenger Trains Provides High Speed Service" by J. E. Moxie et al. The P signal on conductor 30 goes to the propulsion and braking control apparatus 10. Separate speed sensors 15 coupled to the vehicle wheels supply a speed signal to the slip slide monitoring apparatus 32 which provides a slip slide control signal on conductor 34 to the propulsion and braking control apparatus 10 and on conductor 60 to a track adhesion condition sensing apparatus 36 in relation to the time and the extent of each wheel slip or slide condition of the wheels of vehicle 11 in relation to the track 13. The track adhesion condition sensing apparatus 36 provides a control signal on conductor 38 to the speed regulation apparatus 20 such that there results a modification of the desired speed command signal for modifying the speed error signal on conductor 30 going to the propulsion and braking control apparatus 10.

The speed regulation apparatus 20 is operative with the speed signal receiver 24 and the speed command decoder 28 such that a plurality of input frequency signals are available over the conductor 22 indicating at what desired speed the vehicle 11 should be running and this supplies a respective crystal oscillator within the speed regulation apparatus 20 to determine the vehicle speed by providing a desired speed signal.

Figure 2:
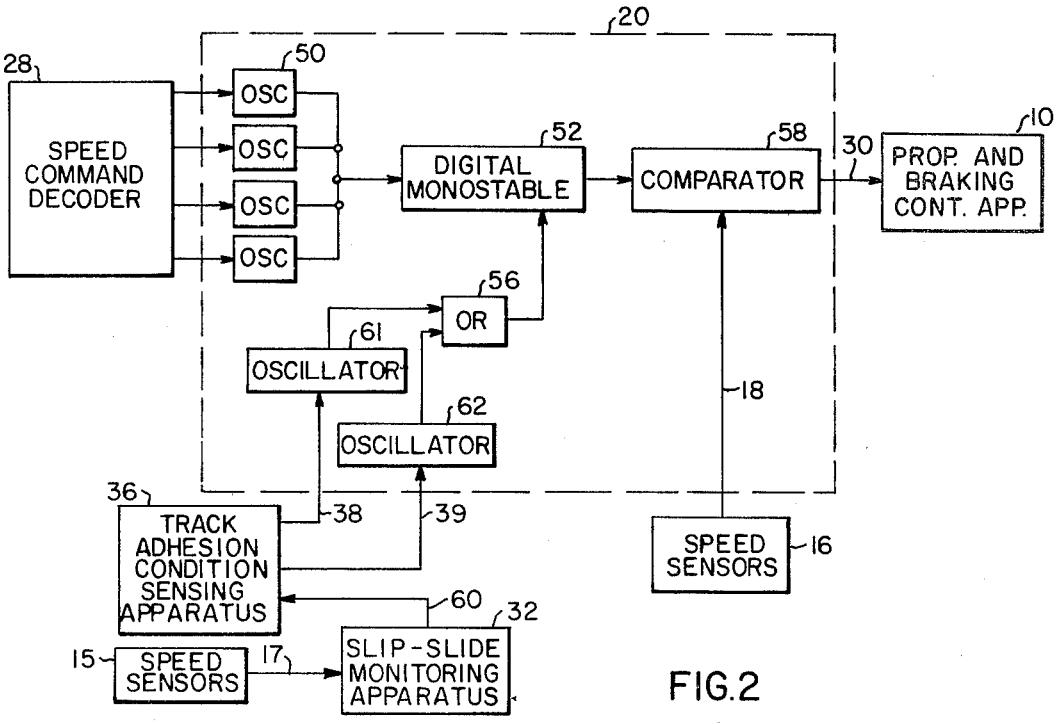
FIG. 2 illustrates the operation of the speed regulation apparatus shown in FIG. 1.

In FIG. 2 the speed regulation apparatus 20 including the provided input crystal oscillators are shown, with the frequency of the desired speed signal being fed from input crystal oscillator 50 into a digital monostable 52, such as disclosed in U.S. Pat. No. 3,749,994 of T. C. Matty, for converting the frequency signal from the crystal oscillator 50 into a precise analog desired speed signal voltage which is supplied to the comparator 58. The speed sensors 16 operative with the wheels of the train vehicle 11 provide an actual speed signal to the comparator 58 for comparison with the desired speed signal from the digital monostable 52 such that a speed error signal is provided by the comparator 58 over the conductor 22 to the propulsion and braking control apparatus 10. In addition the actual speed signal from the speed sensor 15 is supplied to a slip slide monitoring apparatus 32 which provides an output signal over the conductor 60 when there is an excessive slip condition sensed or there is an excessive slide condition sensed between the wheels of the train vehicle 11 and the track 13. When the control signal on the conductor 60 is provided, a crystal oscillator 62 having a predetermined frequency of operation is energized to supply a signal through the OR gate 56 to the digital monostable 52. The crystal oscillator 62 operates at a higher frequency as compared to the crystal oscillator 61 to in effect reduce the magnitude of the analog output voltage supplied by the digital monostable 52 and this operates to lower the speed of the train vehicle 11. As well known to persons skilled in this art, the digital monostable 52 can provide an output average D.C. voltage which is a function of the pulse rate determined by the input frequency signal from oscillator 50 and a function of the pulse period determined by the frequency of the input frequency signal from one of oscillators 61 and 62. Since the frequency of oscillator 62 is higher than the frequency of oscillator 61, the pulse period is less for the former oscillator 62 and the output voltage from the digital monostable will be correspondingly less. By proper selection of the respective frequency of the crystal oscillator 62 as compared to the frequency of the crystal oscillator 61, any percentage of speed reduction for the train vehicle 11 can be provided as desired in relation to the slip condition or the slide condition sensed between the wheels of the train vehicle 11 and the track 13.

Figure 3:
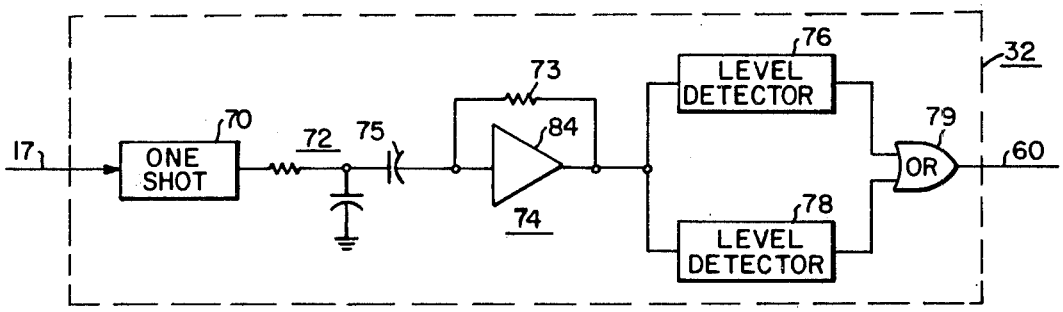
FIG. 3 illustrates the operation of the slip slide monitoring apparatus shown in FIG. 1.

In FIG. 3 there is functionally illustrated the operation of the slip slide monitoring apparatus 32 such that the actual speed signal from the speed sensors 16 is supplied over conductor 17 to a one shot circuit 70. The frequency of the pulse input signal supplied on conductor 17 is proportional to speed and the signal when applied to the one shot 70 gives a calibrated output pulse signal and a repetition rate the same as the rate of the input signal on conductor 17. The output signal from the one shot then passes through a low pass filter 72 and since a known volt time area is involved at a given rate the average voltage is proportional to the vehicle speed. A differentiator circuit 74 can be used to sense slip slide conditions and the output of the latter is proportional to the rate of change of the average voltage. A level detector such as a schmidt trigger is provided to sense the positive rate of change in excess of normal and a second level detector 78 is provided to sense the negative rate of change in excess of normal. The OR gate 79 will output a control signal on the conductor 60 if an abnormal slip condition or an abnormal slide condition is sensed between the wheels of the train vehicle 11 in the track 13. For a normal condition no output signal will be provided by the OR gate 79. The resistor 73 and capacitor 75 will sense an out of bounds from normal rate of change of the signal from the one shot 70. The typical acceleration and deceleration for a mass transit system can be in the order of 3 miles per hour per second. The level detectors 76 and 78 are set to detect in the order of an 8 mile per hour per second rate of change of velocity whereas the normal rate of change will be under 3 miles per hour per second. An abnormal slip condition would be faster and have a higher slope to the velocity curve. Once the slip slide monitoring apparatus senses an abnormal condition, an output control signal is provided by the OR gate 79 to the conductor 60 which then becomes operative with the track adhesion monitoring apparatus 36.

In the same way vehicle deceleration monitoring may be used to determine what braking effort is achieved when a maximum rate is requested and if the response is not within allowed specifications then corrective action can be instituted such as lowering the speeds on a speed limit or percentage basis. Similarly, vehicle acceleration monitoring can be provided to allow sensing of poor adhesion level prior to the vehicle reaching a possible unsafe high speed from which is could not safely stop.

Figure 4:
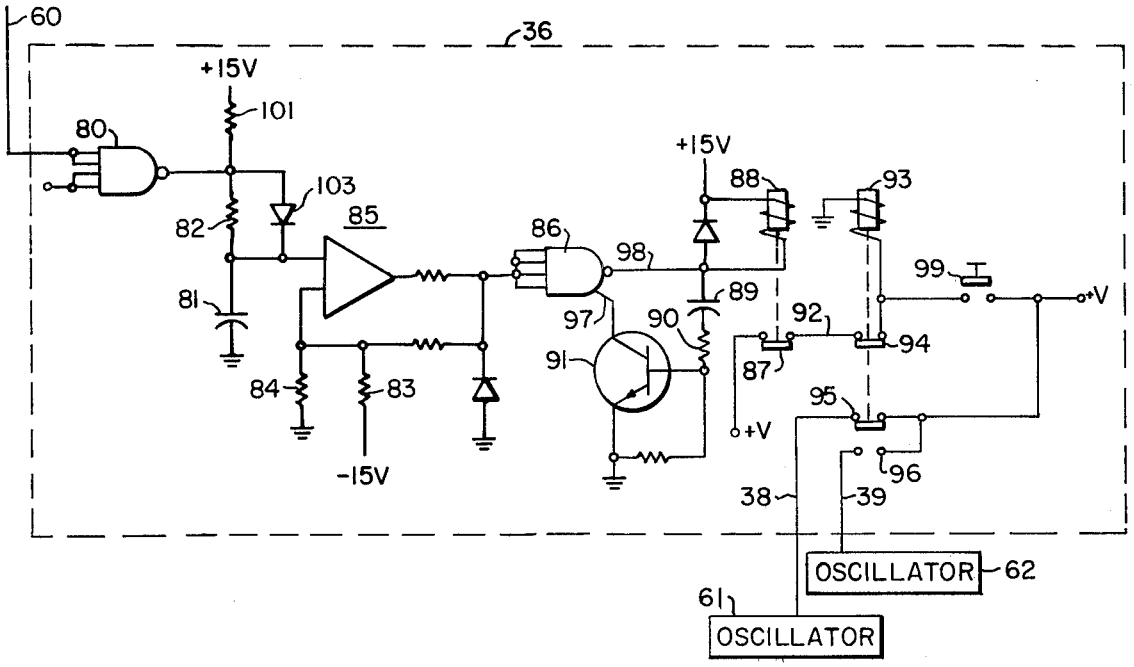
FIG. 4 illustrates the track adhesion condition sensing apparatus shown in FIG. 1.

As shown in FIG. 4, when a slip-slide condition occurs, a positive going signal on conductor 60 is presented to an input of the OR gate 80, and this signal is inverted by OR gate 80 to provide a negative going signal at the output of the OR gate 80. This signal starts discharging the capacitor 81 through resistor 82 at some predetermined rate. If the slip-slide signal presented to the input of OR gate 80 occurs for a long enough time period, the capacitor 81 will discharge below the threshold voltage level established by resistors 83 and 84 for the trigger circuit 85. When the voltage goes below this threshold level, the output of the trigger circuit 85 changes state to go negative. The inverter 86 senses this change of state in the output of trigger circuit 85 and it now provides a positive output to relay 88 to deenergize the relay 88 and open the contacts 87. The contacts 87 can open by gravity and when the isolation relay 88 is energized the contacts 87 will again close. If the slip-slide signal is of a short time duration, the capacitor 81 will not discharge below the threshold voltage level of trigger circuit 85 and the output of the trigger circuit will remain positive and not change state and the relay 88 will remain energized so the contacts 87 will remain closed.

If enough slip-slide signals 60 occur adequate to discharge the capacitor 81 below the threshold voltage of trigger circuit 85, the output of the trigger circuit 85 will change to negative and cause the contacts 87 to open as previously explained.

The capacitor 89, resistor 90, transistor 91 operate as a minimum pulse circuit to assure that once the relay 88 is deenergized then the contacts 87 will stay open for a small time duration for the benefit of the speed regulation apparatus 20 to respond adequately to the opening of the contacts 87. When the contacts 87 open, the conductor 92 will no longer provide voltage to energize the relay 93 and this opens by gravity the latching contact 94. In addition the contact 95 now opens to discontinue the operation of oscillator 61, and the contact 96 closes to initiate the operation of the oscillator 62. A momentary manual reset switch 99 is provided to energize the relay 93 and close the contacts 94 and 95 when desired by the train vehicle operator.

The selection of the discharge time constant of capacitor 81 in combination with resistor 82 and the recharge time constant of capacitor 81 in combination with resistor 101 and diode 103 provides a non-symmetrical operation for the determination of the threshold voltage for changing the output of trigger circuit 85. In this regard the following typical component values are suitable for an illustrative particular application of this apparatus:

capacitor 81—10 $\mu$F
resistor 82—50 K
resistor 95—100 K to give a time constant in the order of one-half second. The minimum pulse width circuit operates such that when the output of inverter 86 goes positive, this turns on the transistor 91 through the capacitor 89. The collector of transistor 91 operates with an input 97 of the inverter 86 to cause the output 98 to remain positive for as long as the input 97 is held negative. Since the current into the base of transistor 91 is supplied through the capacitor 89, this current is decreasing as a function of time and will reach a level below which the transistor 91 will shut off to release the input 97 and thereby allow the output 98 to go negative if the output of trigger circuit 85 is positive at this time.

Figure 5:
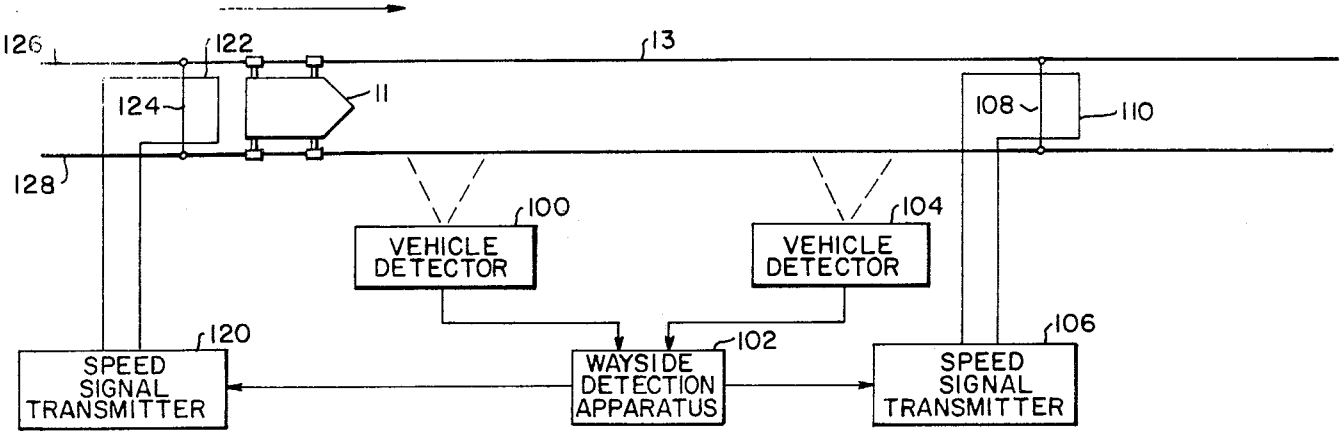
FIG. 5 illustrates a first wayside operative train vehicle adhesion characteristic determination apparatus.

In FIG. 5 there is illustrated the wayside measurement of vehicle performance in relation to a provided speed change signal or an automatic speed change which occurs at a known location along the track. If the train vehicle 11 is running at its normal speed as it passes a predetermined slow down point along the track 13, either the time to reach a fixed distance or the speed of the vehicle at a fixed distance can be measured. In FIG. 5 there is illustrated apparatus for measuring the speed of the vehicle 11 at a fixed distance. The speed signal transmitter 120 operative with antenna 122 in relation to a shunt 124 connected between the rails 126 and 128 of the track 13 is operative to provide a change in the speed command to the vehicle 11 when it enters the track signal block terminated at one end by the shunt 124. When the vehicle reaches the location of vehicle detector 100 a known distance away from the antenna 122 the wayside detection apparatus 102 can establish the time duration of the passage of the vehicle between the location of the vehicle detector 100 and a second vehicle detector 104 having a known spacing or distance between the vehicle detector 100 and the vehicle detector 104. In this way the speed of the vehicle 11 passing between the vehicle detector 100 and the second vehicle detector 104 can be established. Knowing the speed of the vehicle 11 passing between the vehicle detector 100 and vehicle detector 104 permits an evaluation of the available adhesion level of the wheels of the trains vehicle 11 in relation to the track 13 and this permits appropriate wayside vehicle speed control action to be initiated. For example, if the adhesion is poor in this respect the speed command to the train vehicle can be lowered by suitable speed command in subsequent track circuit signal blocks or the safe distance permitted between successive train vehicles could be increased through changes in the provided safe stopping profile.

Figure 6:
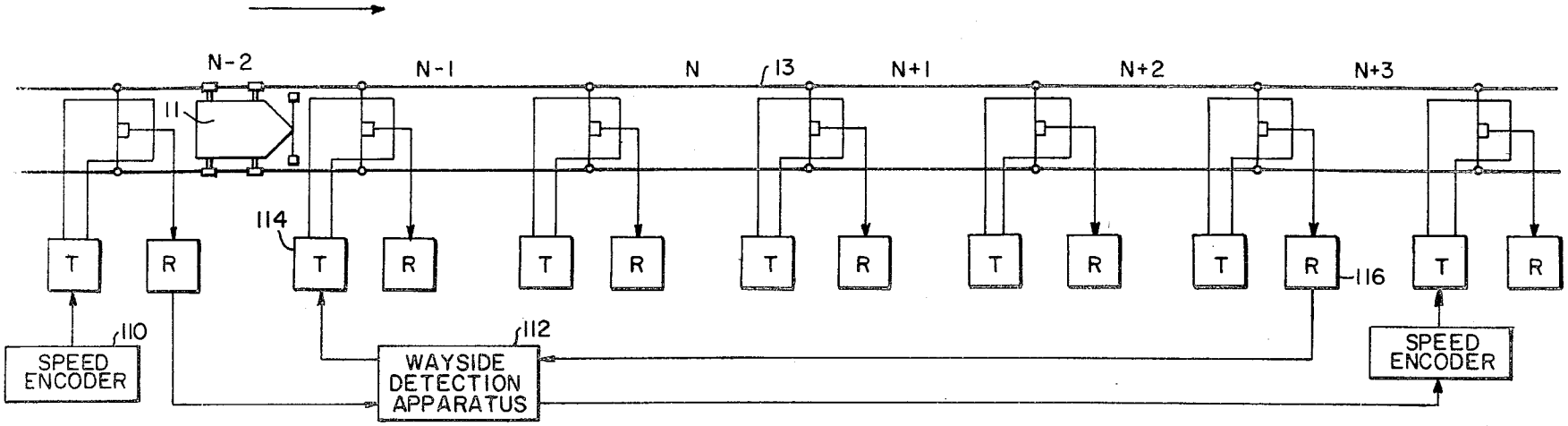
FIG. 6 illustrates a second wayside operative train vehicle adhesion characteristic determination apparatus.

In FIG. 6 there is shown a wayside detection of vehicle performance in relation to illustrated track circuit signal blocks N−2, N−1, N, N+1, N+2 and N+3 as determined by shunt connectors between the rails of the track 13. A speed encoder 110 operative with the track circuit signal block N=2 is operative to provide a predetermined vehicle desired speed level within the signal block N−2. The wayside detection apparatus 112 is operative with the transmitter 114 to provide a different speed of operation in relation to the signal block N−1 and the receiver 116 is operative with the wayside detection apparatus 112 to determine when the train vehicle 11 enters the signal block N+2. Since the physical distance between the signal block N−1 and the signal block N+2 is known, this permits the wayside detection apparatus to determine the vehicle acceleration or deceleration between the change of speed command provided by the transmitter 114 in relation to track circuit signal block N−1 and the time required for the vehicle to reach the signal block N+2.

The vehicle measurement illustrated by FIGS. 5 and 6 are vehicle passive and can be implemented on a zone region basis and could control the vehicles passing through the particular zones involved. The control apparatus illustrated in FIG. 1 is carried by the train vehicle.

In addition to the control apparatus as shown in FIG. 1, it is feasible to send a signal from the vehicle whenever a poor adhesion condition is established which transmission could take place at identified locations or it could be sent through a radio link such that a system or a subsystem speed restriction could then be enforced as considered to be necessary. In the operation of the control apparatus as shown in FIGS. 1 and 2, the speed control provided by the crystal oscillator 62 could for example provide a running speed of 75% of the otherwise desired speed provided by the desired speed signal from the speed command decoder 28 if desired.

We claim:

1. In train vehicle speed control apparatus for determining the operation of a train vehicle having at least one wheel operative with a track, the combination of:

means for sensing the actual rate of change of the speed of said wheel;

adhesion condition sensing means operative with said actual rate of change sensing means for determining when said actual rate of change is greater than a predetermined rate of change;

means operative with said adhesion condition sensing means for providing a first speed control signal when said actual rate of change is not greater than said predetermined rate of change;

means operative with said adhesion condition sensing means for providing a second speed control signal when said actual rate of change is greater than said predetermined rate of change, and means for controlling the speed of said train vehicle in response to one of said first speed control signal and said second speed control signal, with the first speed control signal having a frequency different than the second speed control signal, and with said speed controlling means being responsive to the pulse period of the first and second speed control signals.

* * * * *